US006018063A

United States Patent [19]

Isbell et al.

[11] Patent Number: 6,018,063

[45] Date of Patent: Jan. 25, 2000

[54] BIODEGRADABLE OLEIC ESTOLIDE ESTER BASE STOCKS AND LUBRICANTS

[75] Inventors: Terry A. Isbell, Elmwood; Thomas P. Abbott; Svajus Asadauskas, both of Peoria; Joseph E. Lohr, Jr., Hoffman Estates, all of Ill.

[73] Assignee: The United States of America as represented by the Secretary of Agriculture, Washington, D.C.

[21] Appl. No.: 09/191,907

[22] Filed: Nov. 13, 1998

[51] Int. Cl.[7] ..... C07C 59/00

[52] U.S. Cl. ..... 554/213; 554/219; 508/460; 508/463; 508/465

[58] Field of Search ..... 554/213, 219; 508/460, 463, 465

[56] References Cited

U.S. PATENT DOCUMENTS

| | | | |
|---|---|---|---|
| 5,204,375 | 4/1993 | Kusakawa et al. | 514/784 |
| 5,380,894 | 1/1995 | Burg et al. | 554/219 |
| 5,658,863 | 8/1997 | Duncan et al. | 508/485 |

OTHER PUBLICATIONS

Bruetting et al., Chem. abstr. 119:98404, 1993.

Terry A. Isbell et al. "Acid–Catalyzed Condensation of Oleic Acid into Estolides and Polyestolides" *JAOCS*, vol. 71, No. 2 (Feb. 1994) pp. 169–174.

Terry A. Isbell et al. "Characterization of Estolides Produced from the Acid–Catalyzed Condensation of Oleic Acid" *JAOCS*, vol. 71, No. 4 (Apr. 1994) pp. 379–383.

Selim M. Erhan et al. "Estolide Production With Modified Clay Catalysts and Process Conditions" *JAOCS*, vol. 74, No. 3 (1997) pp. 249–254.

Terry A. Isbell et al. "Optimization of the Sulfuric Acid–Catalyzed Estolide Synthesis from Oleic Acid" *JAOCS*, vol. 74 No. 4 (1997) pp. 473–476.

*Primary Examiner*—Deborah D Carr

*Attorney, Agent, or Firm*—M. Howard Silverstein; Curtis P. Ribando; John D. Fado

[57] ABSTRACT

Esters of estolides derived from oleic acids are characterized by superior properties for use as lubricant base stocks. These estolides may also be used as lubricants without the need for fortifying additives normally required to improve the lubricating properties of base stocks.

12 Claims, No Drawings

BIODEGRADABLE OLEIC ESTOLIDE ESTER BASE STOCKS AND LUBRICANTS

BACKGROUND OF THE INVENTION

1. Field of the Invention

This invention relates to esters of oleic acid estolides and their use as biodegradable base stocks and lubricants.

2. Description of the Prior Art

Synthetic esters, such as polyol esters and adipates, low viscosity poly alpha olefins (PAO), such as PAO 2, vegetable oils, especially Canola oil and oleates are used industrially as biodegradable basestocks to formulate lubricants. Lubricants usually contain 80–100% wt. basestock and 0–20% wt. additives to tailor their viscometric properties, low temperature behavior, oxidative stability, corrosion protection, demulsibility and water rejection, friction coefficients, lubricities, wear protection, air release, color and other properties. Biodegradability cannot be improved by using additives.

In the recent prior art, a fair amount of attention has been given to estolides as having potential for base stocks and lubricants. An estolide is a unique oligomeric fatty acid that contains secondary ester linkages on the alkyl backbone of the molecule.

Estolides have typically been synthesized by the homopolymerization of castor oil fatty acids [Modak et al., JAOCS 42:428 (1965); Neissner et al., *Fette Seifen Anstrichm* 82:183 (1980)] or 12-hydroxystearic acid [Raynor et al., *J. Chromatogr.* 505:179 (1990); Delafield et al., *J. Bacteriol.* 90:1455 (1965) under thermal or acid catalyzed conditions. Yamaguchi et al., [Japanese Patent 213,387, (1990)] recently described a process for enzymatic production of estolides from hydroxy fatty acids (particularly ricinoleic acid) present in castor oil using lipase. Estolides derived from these sources are composed of esters at the 12 carbon of the fatty acids and have a residual hydroxyl group on the estolide backbone. In addition, the level of unsaturation in the produced estolides (expressed through e.g. iodine value) is not significantly lower than that in raw materials, i.e., hydroxy fatty acids.

Erhan et al. [JAOCS, 70:461 (1993)], reported the production of estolides from unsaturated fatty acids using a high temperature and pressure condensation over clay catalysts. Conversion of the fatty acid double bond into an ester functionality is a strikingly different method than the hydroxy esterification process.

SUMMARY OF THE INVENTION

We have now discovered a family of novel estolide compounds derived from oleic acids and characterized by superior properties for use as lubricant base stocks. These estolides may also be used as lubricants without the need for fortifying additives normally required to improve the lubricating properties of base stocks.

The estolide esters of this invention are generally characterized by Formula I:

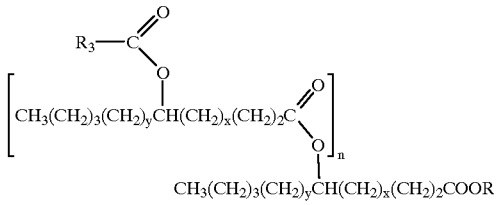

wherein x and y are each equal to 1 or greater than 1;
wherein x+y=10;
wherein n is 0, 1, or greater than 1;
wherein R is $CHR_1R_2$;

wherein $R_1$ and $R_2$ are independently selected from hydrogen and C1 to C36 hydrocarbon which may be saturated or unsaturated, branched or straight chain, and substituted or unsubstituted;

wherein $R_3$ is a residual fragment of oleic, stearic or other fatty acid chain; and wherein the predominant species of secondary ester linkage is at the 9 or 10 position; that is, wherein x=5 or 6 and y=5 or 4, respectively.

In accordance with this discovery, it is an object of this invention to provide novel estolide compounds having utility as lubricant base stocks and also as lubricants without the necessity for inclusion of conventional additives.

It is a further object of this invention to provide a family of estolides which are biodegradable and which have superior oxidative stability, low temperature and viscometric properties.

Other objects and advantages of this invention will become readily apparent from the ensuing description.

DETAILED DESCRIPTION

For purposes of this invention, the term "monoestolides" is used generically to refer to the acid form of compounds having the structure of Formula I, wherein n=0. The term "polyestolides" is used herein to refer to the acid form of compounds having the structure of Formula I, wherein n is greater than 0. The terms "ester", "estolide ester" and the like are generally used herein to refer to products produced by esterifying the residual fatty acid (attachment of the R group in Formula I) on the estolide or estolide mixtures as described below. Of course, estolides are esters resulting from secondary ester linkages between fatty acid chains, and every effort will be made herein to distinguish the actual estolide from the ester thereof.

The production of monoestolides and polyestolides by various routes is fully described in Isbell et al. (I) [JAOCS, Vol. 71, No. 1, pp. 169–174 (February 1994)], Erhan et al. [JAOCS, Vol. 74, No. 3, pp. 249–254 (1997)], and Isbell et al. (II) [JAOCS, Vol. 74, No. 4, pp. 473–476 (1997)], all of which are incorporated herein by reference. Though not required, it is preferred for purposes of quality control that the starting material be as pure in oleic acid as practical. Isbell et al. (III) [JAOCS, Vol. 71, No. 1, pp. 379–383 (April, 1994)], characterize the oleic estolides produced by acid catalysis as being mixture of monoestolides and polyestolide oligomers up to eight or more fatty acid molecules interesterified through secondary ester linkages on the alkyl backbone. This publication also teaches that the positions of these secondary ester linkages were centered around the original C-9 double bond position, with linkages actually ranging from positions C-5 to C-13 and most abundantly at the C-9 and C-10 positions in approximately equal amounts.

Likewise, the remaining unsaturation on the terminal fatty acid was distributed along the fatty acid backbone, presumably also from C-5 to C-13. The linkages of the estolides of this invention would have the same or approximately the same distribution of linkages reported by Isbell et al. 1994. Therefore, it is to be understood that Formula I, supra, is a generalization of the estolide backbone structure of the compounds contemplated herein, and that the formula is intended to encompass normal distributions of reaction products resulting from the various reaction procedures referenced above. Applicants believe that the superior properties of the subject estolide esters are dictated not so much by positions of the linkage and the site of unsaturation, but more by the combination of the degree of oligomerization, decrease in level of unsaturation, the virtual absence of hydroxyl functionalities on the estolide backbone, and the nature of the specific ester moiety (R). However, the process inherently introduces a distribution of secondary linkage positions in the estolide, which in general, affects low temperature and viscometric behavior very favorably. Minor components other than oleic acid, such as linoleic acid or stearic acid may lead to variations in the basic estolide structure shown in Formula I.

The oleic acid estolides for use in making the esters of this invention can be recovered by any conventional procedure. Typically, the preponderance of low boiling monomer fraction (unsaturated fatty acids and saturated fatty acids) and also dimer acids that may form are removed. In a preferred embodiment, reaction conditions will be selected such that no, or substantially no, dimer acids are produced in the course of reaction, with only estolides being formed and the residue fraction comprising substantially pure estolides.

The oleic estolides are esterified by normal procedures, such as acid-catalyzed reduction with an appropriate alcohol. In the preferred embodiment of the invention, $R_1$ and $R_2$ are not both hydrogen, and more preferably, neither $R_1$ nor $R_2$ is hydrogen. That is, it is preferred that the reactant alcohol be branched. In the most preferred embodiment of the invention, the oleic estolide esters are selected from the group of isopropyl ester, 2-ethylhexyl ester and isostearyl ester. It is also preferred that the average value of n in Formula I is greater than about 0.5 and more preferably greater than about 1.0.

Particularly contemplated within the scope of the invention are those esters which are characterized by: a viscosity at 40° C. of at least 20 cSt and preferably at least about 32 cSt; a viscosity at 100° C. of at least 5 cSt and preferably at least about 8 cSt; a viscosity index of at least 150; a pour point of less than −21° C. and preferably at least −30° C.; a volatility of less than 10% at 175° C.; an insignificant (<10%) oxypolymerization in 30 min at 150° C. in the micro oxidation test [Cvitkovic et al., *ASLE Trans.* 22:395 (1979); Asadauskas, PhD Thesis, Pennsylvania State Univ. p.88 (1997)]; and a biodegradability in the OECD Test greater than 70%. Determination of these properties by conventional test procedures are routine. Therefore, identification of oleic estolide esters within the scope of Formula I would be fully within the skill of the ordinary person in the art.

As previously indicated and as demonstrated in the Examples, below, the oleic estolide esters of this invention have superior properties which render them useful as base stocks for biodegradable lubricant applications, such as crankcase oils, hydraulic fluids, drilling fluids, two-cycle engine oils and the like. Certain of these esters meet or exceed many, if not all, specifications for some lubricant end-use applications without the inclusion of conventional additives.

When used as a base stock, the subject esters can be admixed with an effective amount of other lubricating agents such as mineral or vegetable oils, other estolides, poly alpha olefins, polyol esters, oleates, diesters, and other natural or synthetic fluids.

In the preparation of lubricants, any of a variety of conventional lubricant additives may optionally be incorporated into the base stock in an effective amount. Illustrative of these additives are detergents, antiwear agents, antioxidants, viscosity index improvers, pour point depressants, corrosion protectors, friction coefficient modifiers, colorants, antifoam agents, demulsifiers and the like.

The expression "effective amount" as used herein is defined to mean any amount that produces a measurable effect for the intended purpose. For example, an effective amount of an antiwear agent used in a lubricant composition is an amount that reduces wear in a machine by a measurable amount as compared with a control composition that does not include the agent.

EXAMPLE 1

Preparation of 2-Ethylhexyl Oleic Estolide (Laboratory)

To 1000 ml of commercial grade oleic acid (70% oleic) in a 3000 ml 3-neck flask evacuated to 27 in (686 mm) of Hg is added 50 ml sulfuric acid over the course of 4 min. The temperature was maintained at 55° C. for 24 hr and a stirring rate of 300 rpm. After breaking the vacuum with nitrogen, 373 ml (2.39 moles, 1.1 mole equivalents) of 2-ethylhexyl alcohol was added to the flask over 5 min and then the vacuum was restored. After mixing for 2 hrs. at 55° C., 190 g of $Na_2HPO_4$ in 2 L of water was added with vigorous stirring. The mixture was allowed to stand overnight and the water layer was removed. Product was recovered by removing the alcohol utilizing vacuum distillation at 0.1–0.5 torr at 100° C.

Over the course of three runs, the overall yield of product ranged from 82–84%, and the average value of n in Formula I was 1.2.

EXAMPLE 2

Preparation of 2-Ethylhexyl Oleic Estolide (Pilot)

A pilot scale production of 2-ethylhexyl oleic estolide was conducted as follows:

Two hundred fifty pounds (113 kg) of oleic acid (commercial grade) was added to a plastic-lined drum and degassed with a nitrogen sparge for 15 minutes. Twenty-three pounds (10 kg) of concentrated sulfuric acid was added slowly with stirring, maintaining the temperature below 55° C. by the rate of addition. The drum temperature was maintained after the sulfuric acid was all added by storing in a heated room at 55° C. After 24 hours, one forty-pound (18 kg) sample was removed and the acid value and iodine value were checked. Sixty-eight pounds (31 kg) of 2-ethylhexanol were then added, and after 2 hours the hydroxyl value was confirmed as being less than 10.0, signaling completion of the reaction. The reaction mixture was washed by mixing with a 10% solution of potassium hydrogen phosphate [50 lbs (23 kg) $K_2HPO_4$ in 500 lbs (227 kg) city water]. After separation for 1 hour by settling, the pH was checked in both layers to be 5–6 and the water layer was decanted. After separation, the estolide ester was transferred to a kettle and vacuum dried to 105° C. and 29 in of Hg to remove excess water and 2-ethylhexanol. The vacuum drying was followed by pressure filtration using 0.5% filter aid. The value of n in Formula I was 0.5.

EXAMPLE 3

Characterization of Physical Properties of 2-Ethylhexyl Oleic Estolide From Example 2

Biodegradation is usually tested using the Modified Sturm test, measuring the percent degradation in 28 days (OECD 301 B). Biodegradabilities of the major basestocks are compared to that of nonesterified oleic estolide in Table I. It is expected that the 2-ethylhexyl ester of the oleic estolides would not have substantially different biodegradability than the nonesterified estolides.

Viscometric properties determine the flow characteristics of the lubricants, their film thickness, and their ability to maintain a lubricating film under varying temperatures. In the lubricant industry these properties are determined by measuring kinematic viscosities using Cannon-Fenske viscometers and then assigned to viscosity grades. ISO 32 and ISO 46 grades are the most popular. Key viscometric properties of major basestocks used industrially to make biodegradable lubricants are compared to 2-ethylhexyl (2EH) ester of oleic estolide in Table II.

Advantage of the estolide is its high viscosity index (VI) and viscosity grade of ISO 46. This compares to viscometric properties of oleates and vegetable oils. This estolide would not need thickeners which are necessary for tridecyl adipate or PAO 2. Presence of polymer based thickeners or viscosity modifiers may cause shear stability problems in formulated lubricants.

Low temperature properties are important for lubricant pumpability, filterability, fluidity as well as cold cranking and startup. Pour point is the most common indicator of the low temperature behavior. Basestocks derived from vegetable oils usually cannot remain liquid in the cold storage test for more than 1 day, therefore, in addition to the pour point, the cold storage test is being developed by ASTM D02 to assess lubricants suitability. Key low temperature properties are compared in Table III. The estolide has significantly better low temperature properties than trioleates, vegetable oils or polyol esters of higher viscosities.

Volatility is very important for lubricant vapor pressure, flammability, volatile burnoff and emissions. Volatility relates to the flash point, which is measured using Cleveland Open Cup test method. Micro oxidation data allows to quantify the volatility at particular temperatures, in this case 150° C. (same range as hydraulic system or engine crankcase). Key volatility properties are compared in Table IV. The estolides are much less volatile than low viscosity PAOs or adipates.

Oxidative stability defines durability of lubricant and its ability to maintain functional properties during its use. Vegetable oil and oleate based lubricants usually suffer from poor oxidative stability. Micro oxidation is recognized in the lubricant industry as a technique to rank oxidative stabilities by quantifying oxypolymerization tendencies. Micro oxidation data are compared in Table V.

Oxidative stability of estolide is comparable to that of fully saturated materials such as PAOs, polyol esters and adipates. Vegetable oils and most of fluids derived from them are clearly inferior to the estolides.

In general, the 2-ethylexyl estolide ester has advantages over vegetable oils and oleates in its oxidative stability and low temperature properties, over low viscosity PAOs and adipates, in volatility, viscometric properties and biodegradability.

EXAMPLE 4

The methyl, butyl, decyl, oleyl, isopropyl, isostearyl and branched C24 esters of oleic estolide were prepared substantially as described in Example 1 for the 2-ethylhexyl ester. These esters were evaluated for melting point, viscosity index, and viscosity at each of 100° F. (38° C.), 40° C. and 100° C. in comparison with known vegetable oils, fatty acids and other estolides and vegetable oil derivatives. The results are given in Table VI.

EXAMPLE 5

The pour points of 12-hydroxy stearic (Guerbet) acid esters and 2-ethylhexyl ester of ricinoleic estolide and oleic estolide were compared (Table VII).

It is understood that the foregoing detailed description is given merely by way of illustration and that modifications and variations may be made therein without departing from the spirit and scope of the invention.

TABLE I

| Property, units (test method) | Estolide | TMP trioleate | Canola oil | PAO 2 | polyol ester | tridecyl adipate |
|---|---|---|---|---|---|---|
| Modified Sturm test, % in 28 days (OECD 301 B) | >80% | 70% | >85% | >70% | <40% | <30% |

TABLE II

| Property, units (test method) | Estolide 2EH | TMP trioleate | Canola oil | PAO 2 | polyol esters | tridecyl adipate |
|---|---|---|---|---|---|---|
| Viscosity at 40° C. (ASTM D 445) | 53.6 | 49 | 38.5 | 5.55 | 78.3 | 27 |
| Viscosity at 100° C. (ASTM D 445) | 9.42 | 9.9 | 8.5 | 1.8 | 11.9 | 5.35 |
| VI (ASTM D 2270) | 161 | 190 | 207 | — | 147 | 135 |

TABLE III

| Property, units (test method) | Estolide 2EH | TMP trioleate | Canola oil | PAO 2 | polyol ester | tridecyl adipate |
|---|---|---|---|---|---|---|
| Pour Point, ° C. (ASTM D 97) | −27 | −24 | −18 | −72 | −21 | −54 |
| Cold storage at −25° C., days | 7+ | <1 | <1 | 7+ | <1 | 7+ |

TABLE IV

| Property, units (test method) | Estolide 2EH | TMP trioleate | Canola oil | PAO 2 | polyol ester | tridecyl adipate |
|---|---|---|---|---|---|---|
| Flash Point, ° C. (ASTM D) | 250 | 315 | 162 | 160 | n.a. | 221 |
| Evaporation, 30 min at 150° C., % wt. (micro oxidation) | 3 | 1 | 1 | 98 | n.a. | 10 |

TABLE V

| Property, units (test method) | Estolide 2EH | TMP trioleate | Canola oil | PAO 2 | polyol ester | tridecyl adipate |
|---|---|---|---|---|---|---|
| High MW products, 30 min at 150° C., % wt. (micro oxidation) | 7 | 30 | 35 | — | <4 | <4 |
| Solid deposits, 30 min at 150° C., % wt. (micro oxidation) | 0 | 3 | 5 | — | 0 | 0 |

TABLE VI

| Sample | | Formula Weight (g/mole) | Melting Point (° C.) | Viscosity Index | Viscosity (cSt) 100° F. | 40° C. | 100° C. |
|---|---|---|---|---|---|---|---|
| Crambe Oil | | 1042 | 6 | 205 | 54.2 | 50.7 | 10.6 |
| Meadowfoam Oil | | 1020 | 1 | 207 | 53.2 | 48.9 | 10.4 |
| Rapeseed Oil | | 1024 | 6 | 203 | 50.0 | 46.5 | 9.8 |
| Soybean Oil | | 924 | −9* | 217 | 35.0 | 33.3 | 7.8 |
| Erucic Acid | | 338 | 35 | 186 | 36.9 | 34.3 | 7.3 |
| Meadowfoam fatty acids | | 310 | | 204 | 24.6 | 22.9 | 5.6 |
| Meadowfoam methyl esters | | 324 | −13 | 201 | 6.3 | 6.0 | 2.2 |
| Meadowfoam butyl esters | | 366 | −16 | 209 | 8.0 | 7.6 | 2.6 |
| Meadowfoam decyl esters | | 450 | −2 | 117 | 12.3 | 11.5 | 3.0 |
| Meadowfoam Oleyl Esters | | 560 | | | | | |
| Meadowfoam Isopropyl Esters | | 352 | 9.1 | 200 | 11.7 | 11.2 | 3.4 |
| Meadowfoam 2-ethylhexyl esters | | 422 | −19.6 | 197 | 10.5 | 9.9 | 3.1 |
| Meadowfoam Isostearyl esters | | 566 | −5.6 | 200 | 21.6 | 20.1 | 5.1 |
| Meadowfoam Branched C24 esters | | 622 | | | | | |
| Oleic Acid | | 282 | 13 | 185 | 20.0 | 19.2 | 4.8 |
| Oleic acid methyl ester | | 296 | −23 | † | 4.9 | 4.7 | 1.8 |
| Oleic acid butyl ester | | 338 | −24 | 226 | 6.7 | 6.3 | 2.3 |
| Oleic acid decyl ester | | 422 | 2 | 198 | 11.4 | 10.8 | 3.3 |
| Oleic acid oleyl ester | | 532 | −10 | 241 | 18.6 | 17.5 | 5.0 |
| Oleic acid isopropyl ester | | 324 | −37 | 192 | 9.5 | 9.1 | 2.9 |
| Oleic acid 2-ethylhexyl ester | | 394 | −39 | 178 | 9.7 | 9.1 | 2.8 |
| Oleic acid isostearyl ester | | 538 | −30 | 353 | 19.6 | 18.2 | 4.8 |
| Oleic acid branched C24 ester | | 622 | −5 | 193 | 25.3 | 23.4 | 5.6 |
| Crambe Estolide | n = 1.3 | 1056 | 0 | 151 | 761.9 | 679.0 | 58.6 |
| Crambe Estolide methyl ester | ↓ | 1070 | −6 | 172 | 196.6 | 177.2 | 24.8 |
| Crambe estolide butyl ester | ↓ | 1112 | −7 | 178 | 214.7 | 192.5 | 27.1 |
| Crambe estolide decyl ester | ↓ | 1196 | 0 | 179 | 207.9 | 187.6 | 26.7 |
| Crambe estolide oleyl ester | ↓ | 1306 | −3 | 181 | 243.6 | 218.4 | 30.4 |
| Crambe Estolide isopropyl ester | ↓ | 1098 | −8 | 168 | 266.2 | 240.8 | 30.5 |
| Crambe estolide 2-ethylhexyl ester | ↓ | 1168 | −12 | 177 | 203.6 | 184.4 | 26.1 |
| Crambe Estolide isostearyl ester | ↓ | 1312 | −19 | 158 | 279.5 | 251.8 | 32.1 |
| Crambe Estolide branched C24 ester | ↓ | 1396 | −13 | 170 | 277.1 | 247.3 | 31.5 |
| Meadowfoam Estolide | n = 0.7 | 834 | 6 | 154 | 255.3 | 229.8 | 27.4 |
| Meadowfoam Estolide methyl ester | ↓ | 848 | −1 | 164 | 130.8 | 115.3 | 17.7 |
| Meadowfoam estolide butyl ester | ↓ | 890 | | | | | |
| Meadowfoam estolide decyl ester | ↓ | 974 | | | | | |
| Meadowfoam estolide oleyl ester | ↓ | 1084 | 2 | 185 | 102.4 | 93.5 | 16.1 |
| Meadowfoam Estolide isopropyl ester | ↓ | 876 | 0 | 167 | 131.2 | 119.1 | 17.8 |
| Meadowfoam estolide 2-ethylhexyl ester | ↓ | 946 | −1 | 172 | 116.8 | 104.2 | 16.5 |
| Meadowfoam Estolide isostearyl ester | ↓ | 1090 | −9 | 166 | 111.9 | 101.8 | 15.8 |
| Meadowfoam estolide branched C24 ester | ↓ | 1174 | | | | | |
| Oleic Estolide | n = 1.5 | 930 | −31 | 148 | 453.9 | 404.9 | 40.0 |
| Oleic Estolide methyl ester | ↓ | 944 | −27 | 170 | 187.7 | 169.1 | 23.7 |
| Oleic estolide butyl ester | ↓ | 986 | −27 | 168 | 265.7 | 238.4 | 30.3 |
| Oleic estolide decyl ester | ↓ | 1070 | −10 | 169 | 164.4 | 149.0 | 21.4 |
| Oleic estolide oleyl ester | ↓ | 1180 | −22 | 180 | 205.4 | 187.2 | 26.8 |
| Oleic Estolide isopropyl ester | ↓ | 972 | −32 | 169 | 224.1 | 200.7 | 26.7 |
| Oleic estolide 2-ethylhexyl ester | ↓ | 1042 | −34 | 167 | 177.9 | 161.2 | 22.5 |
| Oleic Estolide isostearyl ester | ↓ | 1186 | −43 | 169 | 228.6 | 206.6 | 27.4 |
| Oleic estolide branched C24 ester | ↓ | 1270 | −32 | 175 | 188.8 | 169.4 | 24.3 |

*Pour Point

†Viscosity Index can't be determined for oils with viscosity <2.0 cSt @ 100° C.

TABLE VII

| | Pour Points (° C.) | |
|---|---|---|
| | Guerbet ester | 2-EH ester |
| ricinoleic estolide | −12 | not available |
| oleic estolide | −43 | −27 to −35 |

We claim:

1. An estolide compound of the Formula:

I

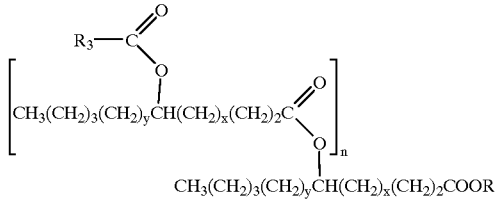

wherein x and y are each equal to 1 or greater than 1;

wherein x+y=10;

wherein n is 0, 1, or greater than 1;

wherein R is $CHR_1R_2$;

wherein $R_1$ and $R_2$ are independently selected from hydrogen and C1 to C36 hydrocarbon which may be saturated or unsaturated, branched or straight chain, and substituted or unsubstituted;

wherein $R_3$ is a residual fragment of oleic, stearic or other fatty acid chain; and wherein the predominant species of secondary ester linkage is at the 9 or 10 position; that is, wherein x=5 or 6 and y=5 or 4, respectively with the proviso that, when n is 0, $R_1$ & $R2$ are not both hydrogen.

2. The estolide compound of claim 1, wherein at least one of $R_1$ and $R_2$ is a C1 to C36 hydrocarbon.

3. The estolide compound of claim 1, wherein both $R_1$ and $R_2$ are C1 to C36 hydrocarbons.

4. The estolide compound of claim 1, wherein n is greater than 0 and R is methyl.

5. The estolide compound of claim 1, wherein R is butyl.

6. The estolide compound of claim 1, wherein R is isopropyl.

7. The estolide compound of claim 1, wherein R is 2-ethylhexyl.

8. The estolide compound of claim 1, wherein R is isostearyl.

9. A lubricant composition comprising (1):

an estolide compound of the Formula:

I

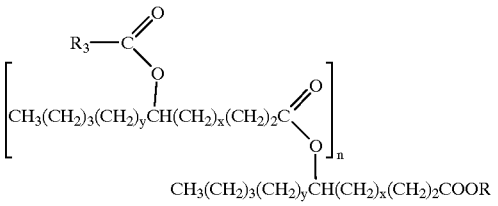

wherein x and y are each equal to 1 or greater than 1;

wherein x+y=10;

wherein n is 0, 1, or greater than 1;

wherein R is $CHR_1R_2$;

wherein $R_1$ and $R_2$ are independently selected from hydrogen and C1 to C36 hydrocarbon which may be saturated or unsaturated, branched or straight chain, and substituted or unsubstituted;

wherein $R_3$ is a residual fragment of oleic, stearic or other fatty acid chain; and wherein the predominant species of secondary ester linkage is at the 9 or 10 position; that is, wherein x=5 or 6 and y=5 or 4, respectively; and (2), an effective amount of lubricating agent.

10. The lubricant composition of claim 9, wherein said lubricating agent is selected from the group consisting of mineral oil, vegetable oil, estolide other than that defined by Formula I, poly alpha olefin, polyol ester, oleate, and diester.

11. The lubricant composition of claim 9 and further comprising an effective amount of a lubricant additive selected from the group consisting of detergent, antiwear agent, antioxidant, viscosity index improver, pour point depressant, corrosion protector, friction coefficient modifier, colorants, antifoam agents and demulsifiers.

12. The lubricant composition of claim 9, wherein when n is 0, $R_1$ & $R_2$are not both hydrogen.

* * * * *